United States Patent [19]

Bauer et al.

[11] 4,275,695

[45] Jun. 30, 1981

[54] DEVICE FOR DETERMINING A FUEL METERING SIGNAL FOR AN INTERNAL COMBUSTION ENGINE

[75] Inventors: Hartmut Bauer, Gerlingen; Peter Schmidt, Schwieberdingen, both of Fed. Rep. of Germany; Herbert Stocker, San Jose, Calif.; Bernd Przybyla, Schwieberdingen, Fed. Rep. of Germany

[73] Assignee: Robert Bosch GmbH, Stuttgart, Fed. Rep. of Germany

[21] Appl. No.: 74,450

[22] Filed: Sep. 11, 1979

[30] Foreign Application Priority Data

Sep. 20, 1978 [DE] Fed. Rep. of Germany ..... 2840793

[51] Int. Cl.[3] ..... F02B 3/00

[52] U.S. Cl. ..... 123/486; 123/487; 123/416

[58] Field of Search ..... 123/32 EB, 32 EC, 117 D, 123/486, 487, 416

[56] References Cited

U.S. PATENT DOCUMENTS

| | | | |
|---|---|---|---|
| 3,914,580 | 10/1975 | Watson et al. | 123/32 EB |
| 3,986,006 | 10/1976 | Kawai et al. | 123/32 EB |
| 3,991,727 | 11/1976 | Kawai et al. | 123/32 EB |
| 4,160,429 | 7/1979 | Morino et al. | 123/32 EB |
| 4,166,437 | 9/1979 | Bianchi et al. | 123/32 EC |
| 4,196,705 | 4/1980 | Hattori et al. | 123/32 EB |

FOREIGN PATENT DOCUMENTS

| | | | |
|---|---|---|---|
| 2804444 | 8/1979 | Fed. Rep. of Germany | 123/32 EC |

*Primary Examiner*—P. S. Lall

*Attorney, Agent, or Firm*—Edwin E. Greigg

[57] ABSTRACT

A device is proposed for determining a fuel metering signal for an internal combustion engine comprising a tachometer, a load detector, as well as a storage element and a summing member. The load signal is preferably selected at certain times and then stored temporarily, wherafter the load signal is optionally corrected, multiplied with a time interval, and the sum total of the multiplication results represent a value with respect to the metering signal. Preferably, the signals are processed in a digital fashion, and the load signal is corrected after having been digitized. This is done because for example, in case of a hot-wire air flowmeter, there is no linearity between air flow (air mass flow) and the output signal of the air flowmeter.

19 Claims, 7 Drawing Figures

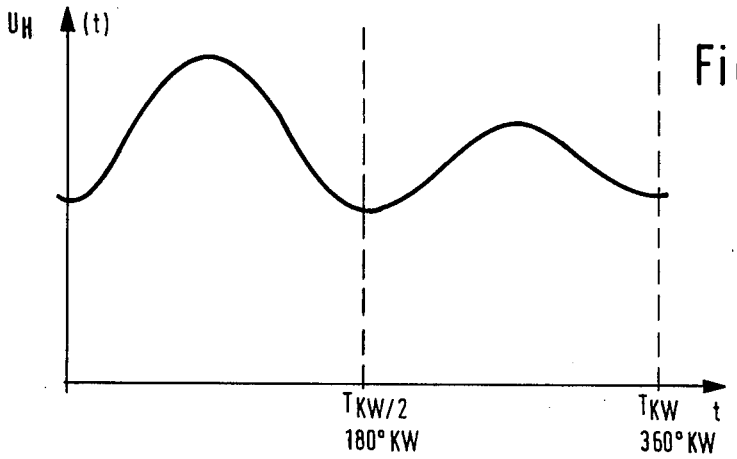
Fig.2
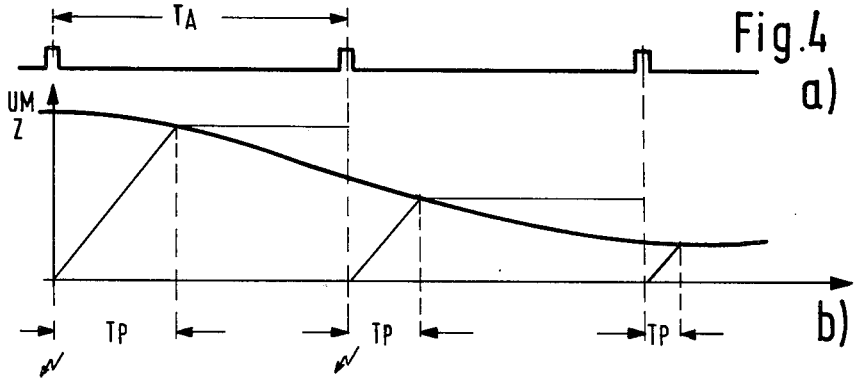
Fig.4
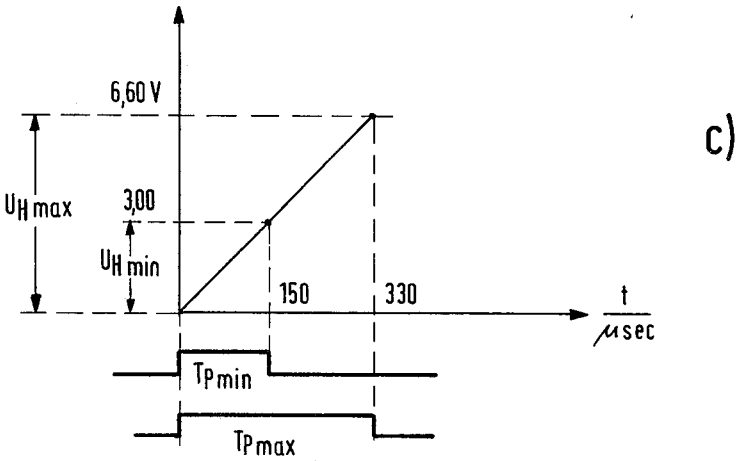

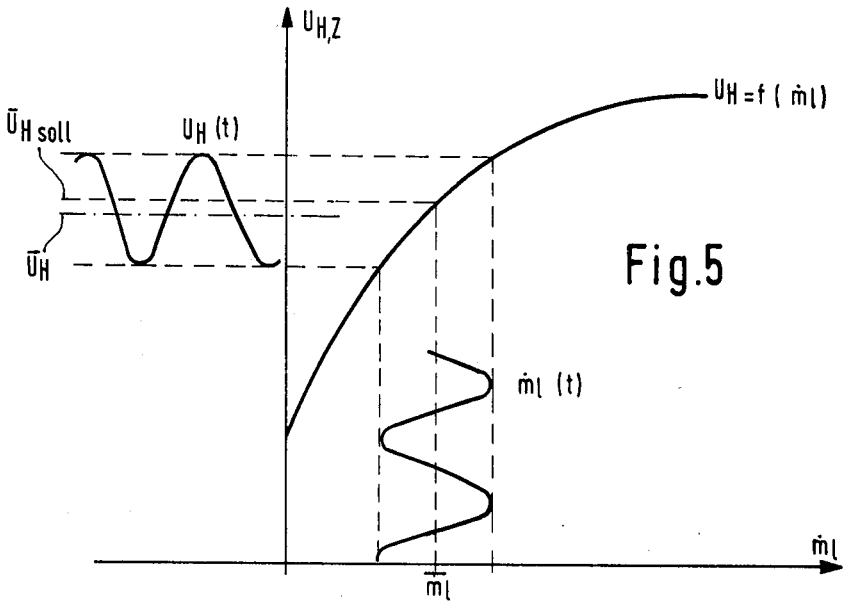
Fig.5
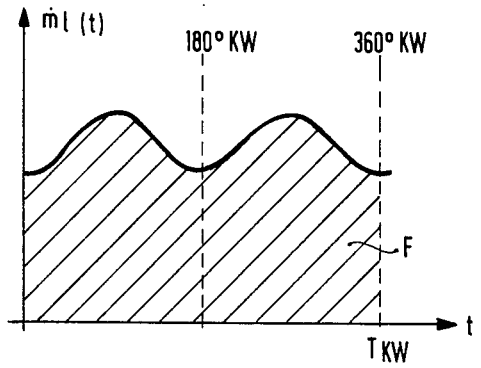
Fig.6
a)
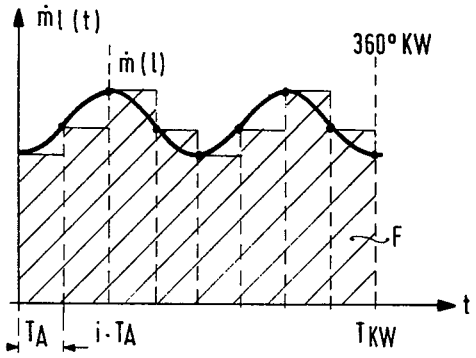
b)

DEVICE FOR DETERMINING A FUEL METERING SIGNAL FOR AN INTERNAL COMBUSTION ENGINE

BACKGROUND OF THE INVENTION

The invention is based on a device for determining a fuel metering signal for an internal combustion engine. A fuel injection device is known wherein the injection time is determined by a charging and discharging process of a storage means. In this procedure, the charging step takes place with a constant signal during a specific angular interval. The discharging step is dependent as to its type and thus also as to its duration on the air flow rate in the intake manifold, and the discharging time in this case corresponds to the injection time.

It was found that this system of determining the injection time caused problems in the case of hot-wire air flowmeters, because such flowmeters do not transmit an output signal proportional to the air quantity, and a corrective interference with the discharge signal of the storage means meets with difficulties.

OBJECT AND SUMMARY OF THE INVENTION

It is an object of this invention to provide a device for determining fuel metering signals which is particularly suitable for processing monlinearities in the output signal of air flowmeters in an optimum and economical fashion.

The device of this invention has an advantage over the conventional device in that, for the formation of the metering signal, the individual operating parameters are processed in a very favorable manner. A metering signal optimally tailored to the needs of the internal combustion engine is constantly made available.

With the device of the invention, it is especially advantageous to transmit the digitized signal of the air flowmeter for linearizing purposes to a linearizing stage representing a performance graph and to process the output signal of such a unit then as the air quantity signal. Since a pulsation of the amount of air in the air intake manifold takes place in certain operating ranges and load conditions of the internal combustion engine whereby the output signal of the air flowmeter is distorted, a further correction performance graph is recommended, which, inter alia, is capable of compensating precisely for these pulsation errors.

The invention will be better understood as well as further objects and advantages thereof become more apparent from the ensuing detailed description taken in conjunction with the drawings.

BRIEF DESCRIPTION OF THE DRAWINGS

In the drawings:

FIG. 2 is a diagram showing the output signal of an air flowmeter plotted over the crankshaft angle;

FIGS. 4(*a*), 4(*b*), and 4(*c*) are three diagrams illustrating the manner in which the air quantity signal is digitized;

FIG. 5 is a performance graph illustrating the output signal of the air flowmeter in dependence on the air flow rate;

FIGS. 6(*a*) and 6(*b*) are curves illustrating the mode of operation of the summing stage in the subject matter of FIG. 3.

DESCRIPTION OF THE EMBODIMENT

Figure 1:
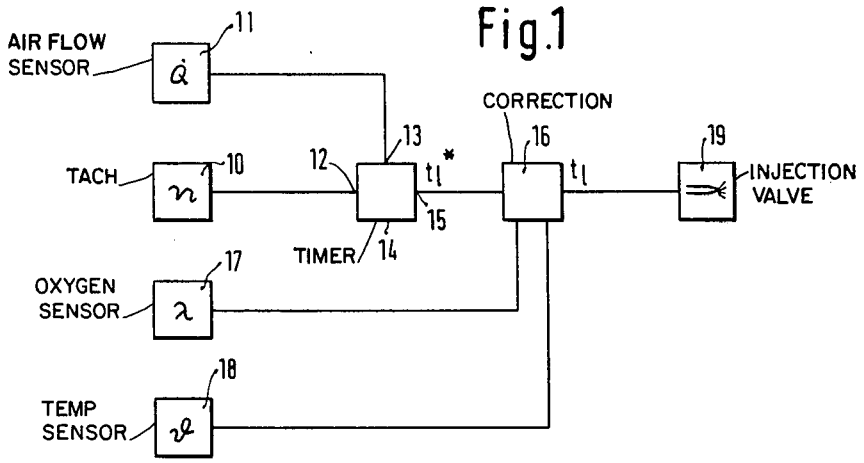
FIG. 1 is a block circuit diagram of a device for the production of injection signals, together with the associated operating parameter pickups.

FIG. 1 is a block circuit diagram directed to an injection system in an internal combustion engine. Reference numeral 10 denotes a tachometer and reference numeral 11 denotes an air flowmeter. The outputs of both sensors 10 and 11 are connected to inputs 12 and 13 of a timing element 14. An uncorrected injection signal having the duration $t_1$ appears at the output 15 of this timing element 14. A correction stage 16 follows for correcting the injection signal determined from speed (number of revolutions) and load in dependence on the output signals of a λ-sensor 17, as well as a thermometer 18. Finally, the correction stage 16 is followed, optionally by way of a driver stage, by the magnetic winding of an electromagnetic injection valve 19.

The block circuit diagram of FIG. 1 applies to the device of the prior art as well as, in principle, to the subject of this invention.

FIG. 2 shows the output signal of the air flowmeter 11 plotted over time. The time axis simultaneously shows angle values for the respective position of the crankshaft. It can be seen that there is a fluctuating air throughput in the intake manifold over a full crankshaft revolution, caused by the fact that the air inlet apertures into the combustion chambers do not always exhibit the same cross section. Although the practice has been to open respectively one valve in case of a four-cylinder engine, and there is even overlapping of the opened inlet valves, the dimension of the total inlet areas as well as the direction of the air streams vary. Thereby, a fluctuating air throughput results in the intake manifold, in accordance with the illustration in FIG. 2. The curve of FIG. 2 shows that, when determining the injection time in dependence on the air flow rate, it is not permissible to use a single, instantaneous value, but rather the air flow rate must be averaged at least over and per a 360° crankshaft angle. To attain this objective, the air quantity signal is integrated over a full crankshaft revolution since, in this case, the entire air flow rate and/or the entire amount of air taken in is covered.

Figure 3:
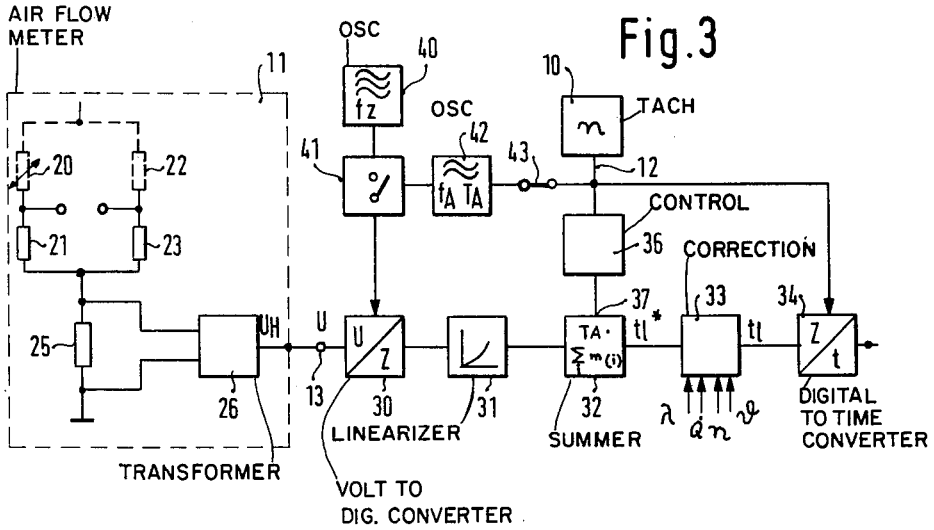
FIG. 3 is a block circuit diagram of an injection pulse generating stage.

FIG. 3 shows a detailed block circuit diagram of the subject matter of FIG. 1. The air flowmeter 11 contains a hot wire 20 in a bridge circuit with three additional resistors 21, 22, and 23, and a measuring resistor 25 is connected to ground in series with this bridge circuit. The voltage across this measuring resistor 25 corresponds in a determinable function to the air flow rate in the intake manifold. This voltage is applied, via a voltage transformer 26, to the output of the air flowmeter 11.

The input 13 of the timing element 14 of FIG. 1 is followed by a voltage-to-digital converter 30 and a linearization stage 31. The linearization stage 31, in turn, is followed by a summing element 32. The summing element 32 acts as an integrator and forms, in this capacity, the sum total of the products of a time interval $T_A$ times the respective quantity of air $m_{(i)}$. The output signal of the summing element 32 in the form of a numerical value is corrected in a further correction stage 33 representing a performance graph and finally fed to a digital-to-time converter 34. The output signal of the digital-to-time converter 34 triggered in dependence on the speed is then transmitted via a driver stage to the injection valves.

The summing element 32 adds the indicated product in each case only over a specific angular range of the crankshaft, so that an addition control stage 36 is connected to the control input 37 of the summing element 32, and the addition control stage 36 is connected, in turn, to the output 12 of tachometer 10.

The voltage-to-digital converter 30 operates according to the so-called counting-out method, i.e., the input voltage value is counted out by means of a constant counting frequency, and this counting step is repeated anew after specific time or angular intervals.

The voltage-to-digital converter 30 cooperates with a first oscillator 40 for the counting frequency, serving by means of a switch 41 for the counting-out process of the input voltage $U_H$ during certain time intervals. A further oscillator 42 takes care, in this process, of the interval control of switch 41. This oscillator 42 yield a pulse signal of an optionally variable frequency. FIG. 3 shows this variation possibility in dependence on the speed with a (closed) switch 43, providing a connection between oscillator 42 and tachometer 10.

The mode of operation of the circuit arrangement according to FIG. 3 can best be described with reference to FIGS. 4–7, wherein the individual figures are associated with individual components of FIG. 3.

In FIGS. 4(*a*), 4(*b*) and 4(*c*), the signal characteristic of the voltage-to-digital converter 30 is illustrated, together with the oscillator 40 and 42, as well as the switch 41. Thus, FIG. 4(*a*) shows the output signal of oscillator 42, the period $T_A$ of which is about one millisecond, to obtain a fine staggering of the air flowmeter output signal to be obtained.

FIG. 4(*b*) shows the mode of operation of the voltage-to-digital converter 30. The curved line shows the output signal of the air flowmeter 11. A counter in the voltage-to-digital converter 30 starts counting, triggered by pulses from oscillator 42, up to a value corresponding to the respective instantaneous value of the input voltage. Since the counting-in process takes place at a constant frequency from oscillator 40, the counting-in time and thus the counting result are proportional to the respective level of the input signal at the end of the counting step.

In FIG. 4(*b*), a very strong time sweep magnification has been chosen. In reality, the jumps in values between two successive counting procedures are not so high, and the output signal of the voltage-to-digital converter exhibits, seen temporally, a hardly recognizable deviation from the input signal, the sole difference being that the respective values are present as digits rather than as analog voltage values. The proportional relationship between the input voltage and the counting-in process on the basis of the constant counting frequency is indicated in FIG. 4(*c*). At the same time, the limits of the input voltage, ${}^{U}H_{min}$ and ${}^{H}H_{max}$ are illustrated, yielding corresponding counting times ${}^{T}P_{min}$ and ${}^{T}P_{max}$.

Since the counter in the voltage-to-digital converter 30 is reset respectively at the beginning of an output pulse of oscillator 42, the counting result is available respectively for a time period sufficient for further processing.

FIG. 5 shows the correlation between air flow rate in the intake manifold and the output signal of the air flowmeter 11. Since the correlation is nonlinear, it is necessary to linearize the signal to avoid an averaging error. Such averaging error is produced, because the fluctuations in the air stream are not tramsitted symmetrically and thus the average value of the output signal is not proportional to the average value of the air flow rate. Although the individual limit values have a fixed correlation, the result, in case of an exactly sinusoidal input signal, is not a likewise sinusoidal output signal, due to the nonlinearity.

To obtain a proportionality between the air flow rate and the air quantity signal, the linearization stage shown in FIG. 3 and denoted by 31 is utilized. This linearization stage can be attained by means of a storage element with nonlinear values read out in correspondence with the respective input signal. Linearization can also be attained via corresponding values in storage element 33, insofar as a certain reduction in accuracy is tolerated.

The curve of FIG. 6 indicates the function and mode of operation of the summing element 32 in FIG. 3.

It is known that the injection time in a fuel injection system must be proportional to the quotient m/n. Since the reciprocal value of the speed corresponds to the duration of the period, the injection time is also proportional to the area below the air flow rate line above the time ($T_{KW}$) of one revolution of the crankshaft. Written mathematically, the following relationship results:

$$t \sim F = \int_{o}^{T_{KW}} \dot{m}_1(t)dt \text{ wherein } T_{KW} = l/n$$

An approximated integration can be formed in a conventional way also by the addition of finite area elements. For this purpose, the previously mentioned integration interval, the period duration of a crankshaft revolution, is subdivided into a plurality of constant time intervals of the duration $T_A$. Then, at the instant of each time interval $T_A$, the associated value of the air flow rate $\dot{m}_1(i)$ is determined and an addition is carried out in correspondence with the following formula:

$$t_i^* \sim F^* = T_A \cdot \sum_{i=o}^{\left[\frac{T_{KW}}{T_A}\right]} \dot{m}_1(i)$$

For an illustrative explanation of the integration and addition processes, reference is made to FIGS. 6(*a*) and 6(*b*). Whereas the curve according to FIG. 6(*a*) does not have any discontinuities in value and slope, and the area therebelow corresponds to the integrated value, the illustration of FIG. 6(*b*) contains, on the time axis, constant time intervals of the duration $T_A$. The corresponding air flow rate value is respectively determined for the instants of initiation of these time intervals. If the duration of the time intervals $T_A$ is selected to be sufficiently short, then the error occurring in the addition step as compared to integration likewise becomes negligibly small.

In the arrangement of FIG. 3, the scanning of the air flow rate value at certain times, as seen in FIG. 6(*b*), and the subsequent addition of the products of time interval and instantaneous flow rate value, are put to use. For this purpose, the addition control stage 36 must control the respective addition processes. This means triggering of the summing element 33 in dependence on the angular positions of the crankshaft, detected by the tachometer 10. The final addition value at the end of a crankshaft revolution is made available as a numerical value to the further stages, for example a further correction stage 33, and thereafter is converted into a time period which then represents the actual injection signal.

In this connection, the digital-to-pulse duration conversion in the digital-to-time converter 34 can take place in dependence on a trigger signal from tachometer 10.

To obtain even at high speeds of the crankshaft of the internal combustion engine a still sufficient, exact addition result, an interval duration $T_A$ is selected of about one millisecond for the scanning process of the air flowmeter output signal.

The summing element illustrated in FIG. 3 and denoted by the reference numeral 32 may be in the form of a minicomputer, the structure of which is known, and the individual components of which are commercially available.

Figure 7:
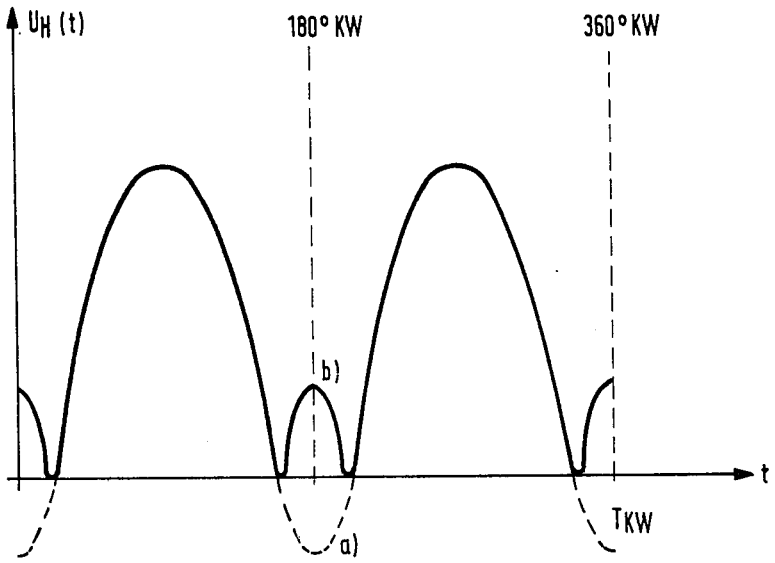
FIG. 7 is a curve illustrating how a pulsation error of the air flowmeter output signal can occur.

In case of a certain combination of the operating parameters of speed and load, the air stream in the air intake manifold can pulsate so strongly that sometimes the air column travels even in opposition to the intake direction. The air flowmeter in the form of a hot wire or hot film normally cannot recognize a reversal in the air stream direction, and thus the output signal of the air flowmeter 11 is incorrect in these special operating conditions. This is clarified in the diagram of FIG. 7. In FIG. 7, the course of the actual air stream is shown in dashed lines, wherein the negative value represents a reversal in the flow direction. Since this reversal in the flow direction is not recognized by the hot wire, serving as the air flowmeter, an air stream toward the internal combustion engine is signaled even during this angular phase.

With the air of the correction stage 33 in FIG. 3, this measuring error can be counteracted by reading out a correspondingly written-in value from the correction stage 33 at certain operating parameters. Furthermore, this correction stage 33 is provided, for example, for correcting the injection signal in dependence on the temperature.

Accordingly, with the aid of the device of this invention, it is possible to exactly determine the fuel metering signal for an internal combustion engine, wherein programmable linearization and correction stages take care of correcting errors resulting from signal processing as well as errors based on the respective type of internal combustion engine, at the respectively most favorable location.

The foregoing relates to a preferred embodiment of the invention, it being understood that other embodiments and variants thereof are possible within the spirit and scope of the invention, the latter being defined by the appended claims.

What is claimed and desired to be secured by letters patent of the United States is:

1. A device for determining a fuel metering signal in an internal combustion engine according to engine parameters having an intake manifold and a crankshaft, wherein the device includes: a tachometer connected to measure engine rpm; an air flowmeter mounted in the air intake manifold which generates voltages such that the voltage amplitude is proportional to air flow in the intake manifold, a storage means connected to the air flowmeter to store the voltages, a time counting circuit connected to the storage means such that the voltages are stored according to a first predetermined time interval, further including:

a summing element connected to the storage means for summing the stored voltages, further connected to detect crankshaft rotation and connected to the time counting circuit which generates a second predetermined time interval wherein the summing element multiplies the stored voltages with the second predetermined time interval during a predetermined crankshaft angle and wherein the summing element generates an output indicative of fuel metering time.

2. A device according to claim 1 including a linearization stage connected to receive and to make linear the voltages and further connected to generate linear air flow valves to the summing element.

3. A device according to claim 2, wherein the output of said linearization stage represents engine performance.

4. A device according to claim 1, wherein the signals in the linearization stage, the correction stage, and the summing element are digital signals.

5. A device according to claim 1, wherein said storage means includes a voltage-to-digital converter which converts the voltages to digital air flow values.

6. A device according to claim 5, wherein the voltage-to-digital conversion in said voltage-to-digital converter takes place by means of a counting-out process of the voltages in first predetermined time intervals.

7. A device according to claim 1, including a correction stage connected to receive the summing element output.

8. A device according to claim 7, wherein the occurrence of a pulsation in the air mass stream in said intake manifold is considered in the stored values of said correction stage.

9. A device according to claim 7, wherein said correction stage includes a voltage-to-digital converter.

10. A device for determining a fuel metering signal in an internal combustion engine according to engine parameters having an intake manifold and a crankshaft, wherein the device includes a tachometer connected to measure engine rpm, an air flowmeter mounted in the air intake manifold which generates voltages such that the voltage amplitude is proportional to air flow in the intake manifold, a storage means connected to the air flowmeter to store the voltages, wherein the crankshaft is connected to the storage means such that the voltages are stored according to a predetermined angle of crankshaft rotation and further including:

a summing element connected to the storage means for summing the stored voltages and further connected to detect crankshaft rotation;

a time counting circuit which generates a predetermined time interval to the summing element wherein the summing element multiplies the stored voltages with the predetermined time interval during a predetermined angle of crankshaft rotation such that the summing element generates an output indicative of fuel metering time.

11. A device according to claim 10, including a linearization stage connected to receive and to make linear the various voltages and further connected to generate linear air flow values to the summing element.

12. A device according to claim 11, wherein the output of said linearization stage represents engine performance.

13. A device according to claim 10, wherein the signals in the linearization stage, the correction stage, and the summing element are digital signals.

14. A device according to claim 10, wherein said storage means includes a voltage-to-digital converter which converts the voltages to digital air flow values.

15. A device according to claim 14, wherein the voltage-to-digital conversion in said voltage-to-digital converter takes place by means of a counting-out process of the voltages in first predetermined time intervals.

16. A device according to claim 10, including a correction stage connected to receive the summing element output.

17. A device according to claim 16, wherein the occurrence of a pulsation in the air mass stream in said intake manifold is considered in the stored values of said correction stage.

18. A device according to claim 16, wherein said correction stage includes a voltage-to-digital converter.

19. A method of determining a fuel metering signal for an internal combustion engine having an intake manifold, comprising the steps of:

generating first signals proportional to the speed of the engine;

generating second signals proportional to instantaneous air flow in the intake manifold;

converting the second signals to digital signals;

making the digital signals linear;

integrating said linearized signals over a time period equal to at least one crank shaft revolution; and converting said integrated signals to a time signal dependent upon said first signals to provide the desired fuel metering signal.

* * * * *